US005713219A

United States Patent [19]

Itzkowitz

[11] Patent Number: 5,713,219

[45] **Date of Patent: *Feb. 3, 1998**

[54] INVISIBLE SETTING FOR PRECIOUS STONES FOR JEWELRY

[75] Inventor: Israel Itzkowitz, North Hollywood, Calif.

[73] Assignee: Ambar Diamonds, Inc., Los Angeles, Calif.

[ * ] Notice: The term of this patent shall not extend beyond the expiration date of Pat. No. 5,649,434.

[21] Appl. No.: 637,512

[22] Filed: Apr. 25, 1996

Related U.S. Application Data

[63] Continuation-in-part of Ser. No. 588,439, Jan. 18, 1996, Pat. No. 5,649,434.

[51] Int. Cl.[6] ..... A44C 17/02

[52] U.S. Cl. ..... 63/26; 63/31; 63/32

[58] Field of Search ..... 63/26, 27, 29.1, 63/31, 32

[56] References Cited

U.S. PATENT DOCUMENTS

| | | | |
|---|---|---|---|
| 2,340,659 | 2/1944 | Goldstein . | |
| 2,364,031 | 11/1944 | Suderov . | |
| 3,286,486 | 11/1966 | Huisman et al. . | |
| 3,763,665 | 10/1973 | Polakiewicz . | |
| 3,788,097 | 1/1974 | Elbe . | |
| 4,020,649 | 5/1977 | Grossbard . | |
| 4,306,427 | 12/1981 | Urban . | |
| 5,115,649 | 5/1992 | Amber | 63/26 |
| 5,123,265 | 6/1992 | Ramot | 63/32 X |
| 5,419,159 | 5/1995 | Muller | 63/32 X |

*Primary Examiner*—Kien T. Nguyen
*Attorney, Agent, or Firm*—Howard C. Miskin

[57] ABSTRACT

A diamond having a girdle with oppositely located flattened portions is disclosed. Each of the flattened portions has a cut-out with sloped walls. The girdle preferably has facets at its circumference, except at its flattened portion. The diamond is set into a barrel having a ridge member comprising a prong dimension to fit into the respective cut-out and to frictionally engage one of the sloped walls of the cut-out, thereby, rigidly securing the diamond to the barrel.

6 Claims, 15 Drawing Sheets

INVISIBLE SETTING FOR PRECIOUS STONES FOR JEWELRY

REFERENCE TO RELATED APPLICATIONS

This application is a continuation-in-part of the application Ser. No. 08/588,439, filed Jan. 18, 1996, now U.S. Pat. No. 5,649,434, and assigned to the same assignee as the present invention.

BACKGROUND OF THE INVENTION

This invention relates to a method and apparatus for setting diamonds or precious stones and, more particularly, for setting a diamond in a mount so that the setting is invisible when one views the diamond and, thus, so that the setting does not detract from the luster of the diamond.

Diamonds emanate a luster that is extremely appealing to a human eye. Diamonds, and gems in general, are cut in a particular form with numerous facets so as to have special brilliance. It is extremely desired that a diamond be set onto a mount, in such a manner that the mount or setting is invisible to the viewer's eye, thereby, inhibiting the mount from detracting from the luster of the diamond that is a measure of the apparent, if not actual, value of the diamond itself. The luster is one of the paramount characteristics of the esthetic appeal of the diamond. The mountings of diamonds so that the mount is invisible are well known in the art and are described, for example, in U.S. Pat. Nos. 5,072,601 ('601) and 5,115,649 ('649), both of which are herein incorporated by reference. The '601 patent discloses square-shaped diamond settings, whereas the '649 patent discloses round diamond settings. The '649 patent further discloses a round diamond having sloped grooves into which is inserted and then rotated complementary walls of a holder to interlock therebetween and form an article of jewelry. The '601 and '649 patents both serve well their intended purpose, but it is further desired that mounting means be provided that are particularly suited for diamonds and which not only provide for invisible settings for the diamonds, but also allow the diamonds to be more easily set into their associated holder without any rotation therebetween, yet rigidly attached thereto. It is desired that the diamond have a round-like shape, including those with only rounded peripheral portions that takes into account generally rounded, oval, pear and marquise gems and diamonds each having multiple facets.

Accordingly, it is a principal object of the present invention to provide a method and an apparatus for invisibly setting diamonds so as to enhance the overall esthetic appeal of the diamonds being worn by respective owners, and yet allow the diamonds to be more easily affixed within their mounting, for example, in a snap-lock manner.

It is another object of the present invention to provide a method and an apparatus for invisibly setting diamonds in which the set diamond is securely held and is unlikely to be accidentally dislodged so as to fall out from the setting thereof.

Further still, it is an object of the present invention to provide a method and an apparatus for invisible settings of diamonds that are held in a mount selected of a material that assists in the securing of the diamond within the mounts.

Moreover, it is an object of the present invention to provide a method and an apparatus for an invisible setting of gems that includes generally rounded, oval, pear and marquise diamonds each having multiple facets.

Other objects, advantages and features of the invention will become more apparent from the following description.

SUMMARY OF THE INVENTION

The present invention is directed to a setting for a diamond that is substantially invisible to the observer's eye, and yet allows for the diamond to be easily and rigidly secured therein. The present invention is particularly suited to generally rounded, oval, pear and marquise diamonds each having multiple facets.

The article of jewelry incorporating the invisible setting of the present invention comprises a diamond, and a barrel having means for serving as a mount for securely holding the diamond. The diamond has a table, a girdle and a pavilion located below the girdle. The girdle has first and second oppositely disposed flattened portions spaced apart by a first predetermined distance and each having a cut-out with a defined width and comprising at least two walls one of which is directed inward and downward into the diamond and the other which is directed inward and upward into the diamond. The at least two walls merge to form a groove that extends across the width of the cut-out. At least one of the two walls have an entrance portion with an upwardly directed portion having a first defined angle relative to the surface of the face. The pavilion preferably has facets comprising sloped walls having a second defined angle relative to the table and different from the first defined angle. The barrel has a bore with a diameter which is less than the first predetermined diameter of the girdle and has an inner wall with a ridge means having a prong and sides oppositely disposed from each other to correspond to the flattened portions. The prong is dimensioned to snugly fit into the cut-outs and engage at least a portion of one of the sloped walls of the cut-out. The invisible setting is achieved because the barrel having the ridge means is set beneath the diamond, thereby, rendering the setting invisible while the diamond is being observed by a normal viewer. The girdle preferably has facets around its perimeter except for the flattened portion thereof.

DETAILED DESCRIPTION OF THE PREFERRED EMBODIMENT

Figure 1:
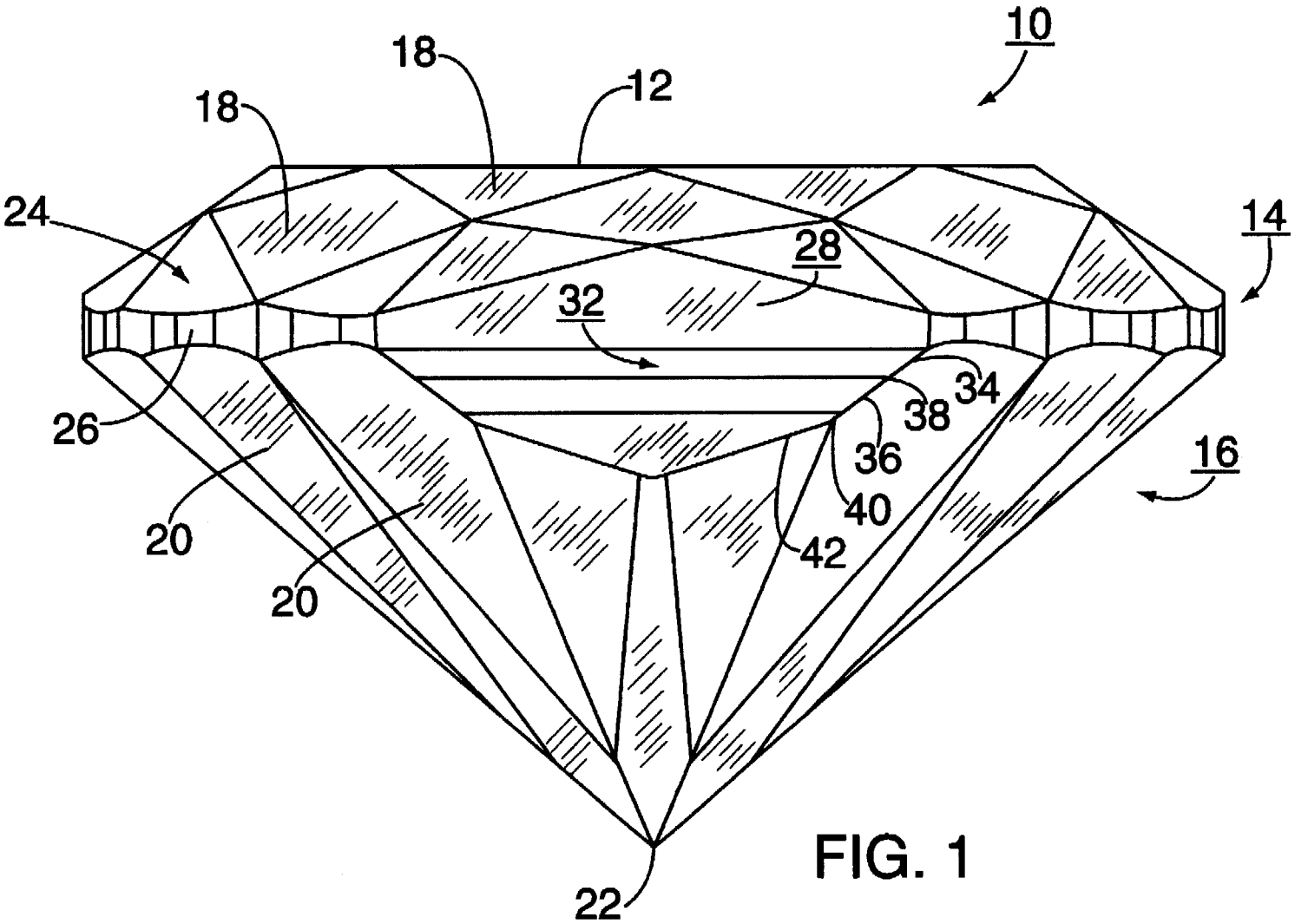
FIG. 1 is a side view of the round diamond of the present invention.

Referring to the drawings, wherein the same reference numbers indicate the same elements throughout, there is shown in FIG. 1 a side view of a generally round diamond 10 or some other precious stone related to the present invention. The generally round diamond of FIG. 1, as well as each of the other diamonds of the present invention to be described, is selected so that its parameters accommodate its mounting or setting into a carrier or mount, commonly referred to as a barrel. The parameters of the diamonds of the present invention are also selected so that the setting is made invisible by each of the diamonds, thereby, holding and yet preventing the setting from distracting from the luster emanating from any of the diamonds of the present invention. The generally round diamond 10 has a table 12, a girdle 14, and a pavilion 16 located below the girdle 14.

The table 12 and the girdle 14 are separated from each other by a plurality of facets 18. The pavilion 16 has a plurality of facets 20 that extend upward (as viewed in FIG. 1) from their origin or tip 22 to the girdle 14. The girdle 14 has a belt 24 that carries a plurality of facets 26. The facets 26 extend all around the periphery of the girdle 14, except for flattened portion 28 and for flattened portion 30 (nod shown in FIG. 1 but shown in FIG. 2A). Each of the flattened portions 28 (see FIG. 1) and 30 has a cut-out 32 which comprises two sloped walls 34 and 36 having predetermined dimensions. As further seen in FIG. 1, each of the sloped walls 34 and 36 runs substantially parallel to the top surface of the table 12. As will be further described with reference to FIG. 6, the sloped wall 34 is directed inward and downward into the generally round diamond 10 of FIG. 1, as well as the other diamonds of the present invention, whereas the sloped wall 36 is directed inward and upward into the generally round diamond 10, as well as the other diamonds of the present invention. The sloped walls 34 and 36 merge to form a groove 38 that preferably extends across the width of the cut-out 36. The outer edge of the sloped wall 36 defines a boundary 40 which abuts up against a prism 42 of pavilion 16.

Figure 2A:
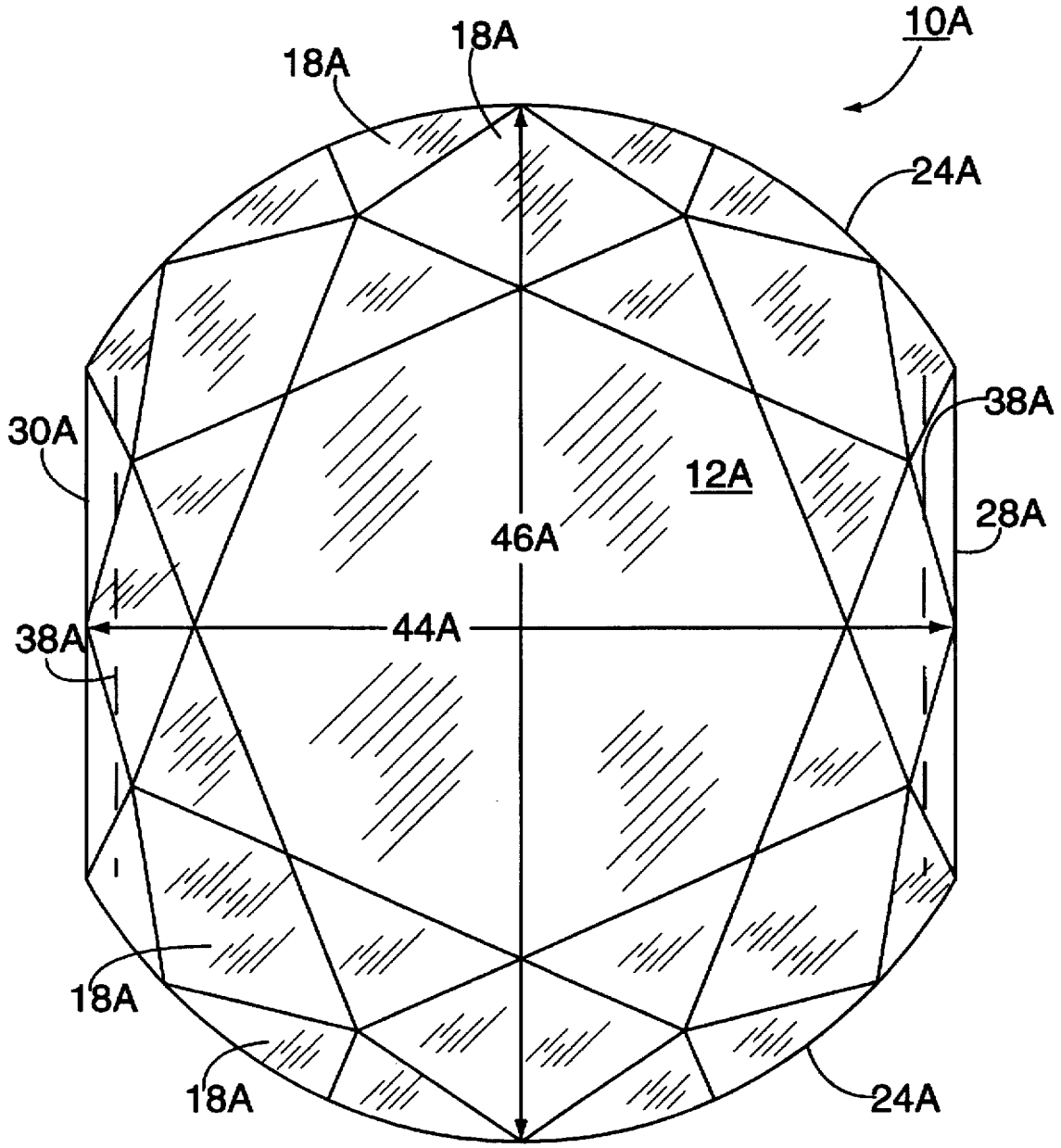
FIG. 2 is composed of 2A, 2B, 2C, and 2D each illustrating a top view respectively of the diamond of FIG. 1, a pear diamond, a marquise diamond and an oval diamond each having multiple facets.

The parameters shown for the generally round diamond 10 of FIG. 1 are equally applicable to the other gems related to the present invention including pear diamonds, marquise diamonds and oval diamonds. The generally round diamond 10 of FIG. 1 is further illustrated in FIGS. 2A, 3A, 4A, 5 and 6, whereas the pear, marquise and oval diamonds are further illustrated in FIGS. 2B, 3B and 4B; 2C, 3C and 4C; and 2D, 3D and 4D. For the sake of brevity, the generally rounded diamond 10 of FIG. 1 is to be fully described with reference to FIGS. 2A, 3A, 4A, 5 and 6, but using the reference numbers of FIG. 1 and adding the symbol A for the description of FIGS. 2A, 3A, 4A, 5 and 6. However, it should be understood that the full description of FIGS. 2A, 3A, 4A, 5 and 6 is equally applicable to the FIGS. 2B, 2C, 2D, 3B, 3C, 3D, 4B, 4C and 4D wherein the pear, marquise and oval diamonds are respectively illustrated with the reference numbers of FIG. 1 and adding the symbols B, C and D thereto. The flattened portions 28 and 30 of FIG. 1 may be further described with reference to FIG. 2A illustrating the flattened portions with the reference nomenclature 28A and 30A.

As seen in FIG. 2A, which is a top view of the generally round diamond 10 but now generally illustrated as 10A, the flattened portions 28A and 30A are devoid of the faceted belt 24. Further, the flattened portions 28A and 30A are disposed from each other on opposite sides of the generally round diamond 10A, and are separated from each other by a first predetermined distance 44A. Furthermore, as indicated in FIG. 2A, the generally round diamond 10A has a predetermined diameter 46A. A review of FIGS. 2B, 2C and 2D will respectively reveal the same features for the pear, marquise and oval diamonds as discussed for the generally round diamond 10A of FIG. 2A. Further details of the generally round diamond 10A, in particular its pavilion 16A, may be further described with reference to FIG. 3A.

Figure 3A:
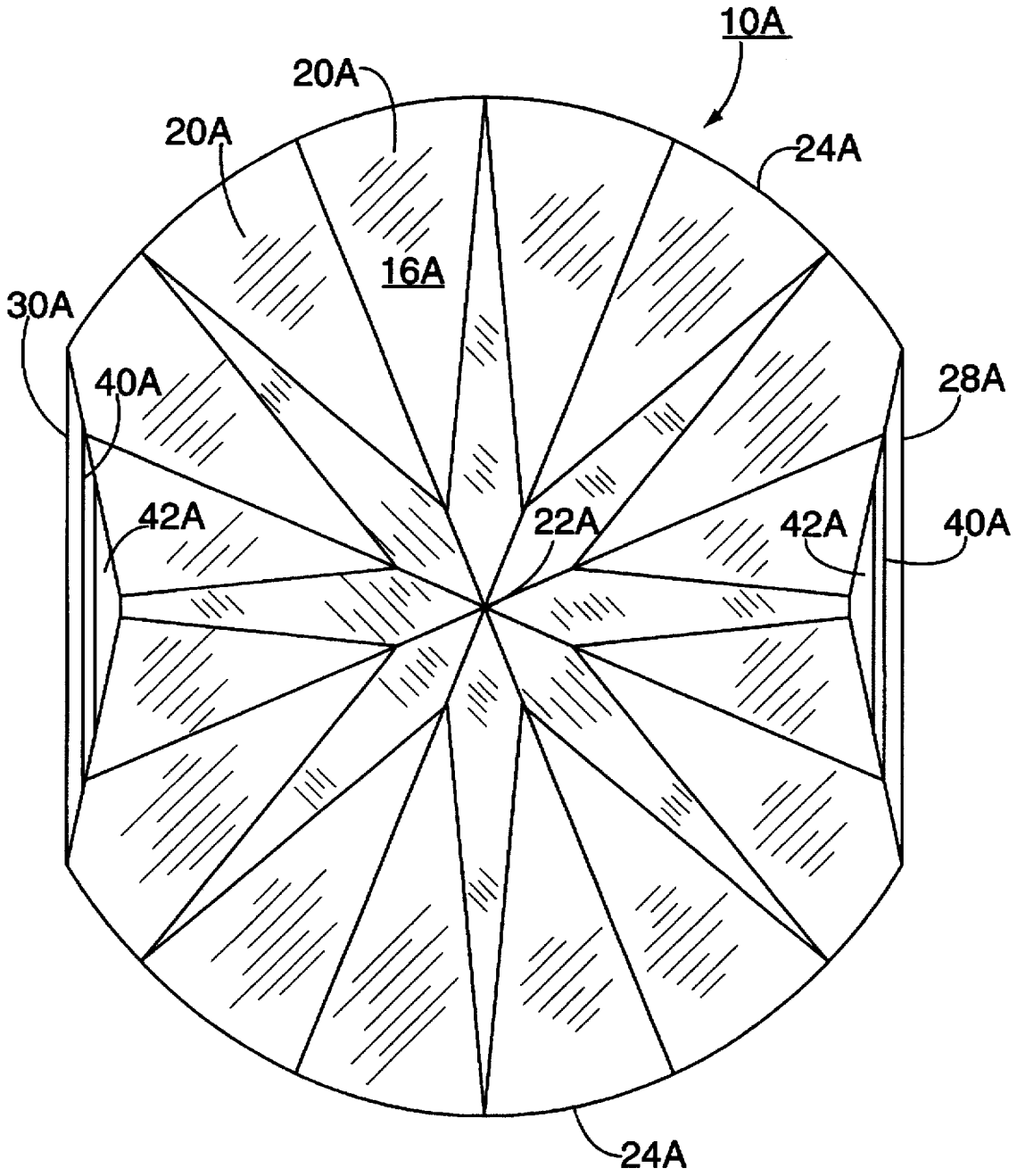
FIG. 3 is composed of FIGS. 3A, 3B, 3C and 3D each illustrating a bottom view respectively a bottom of the diamonds of FIGS. 2A, 2B, 2C and 2D.

FIG. 3A is a bottom view of the round diamond 10A primarily illustrating the pavilion 16A as having a plurality of facets 20A that radiate outward from the central region of pavilion 16A defined by the tip 22A, previously described with reference to FIG. 1 as tip 22. Further, as discussed with reference to FIG. 1, the pavilion 16A has facets 42A each of which is located proximate the flattened portions 28A and 30A. A review of FIGS. 3B, 3C and 3D will respectively reveal the same features for the pear, marquise and oval diamonds as discussed for the generally round diamond 10A of FIG. 3A. The flattened portions 28A and 30A may be further described with reference to FIG. 4A.

Figure 4A:
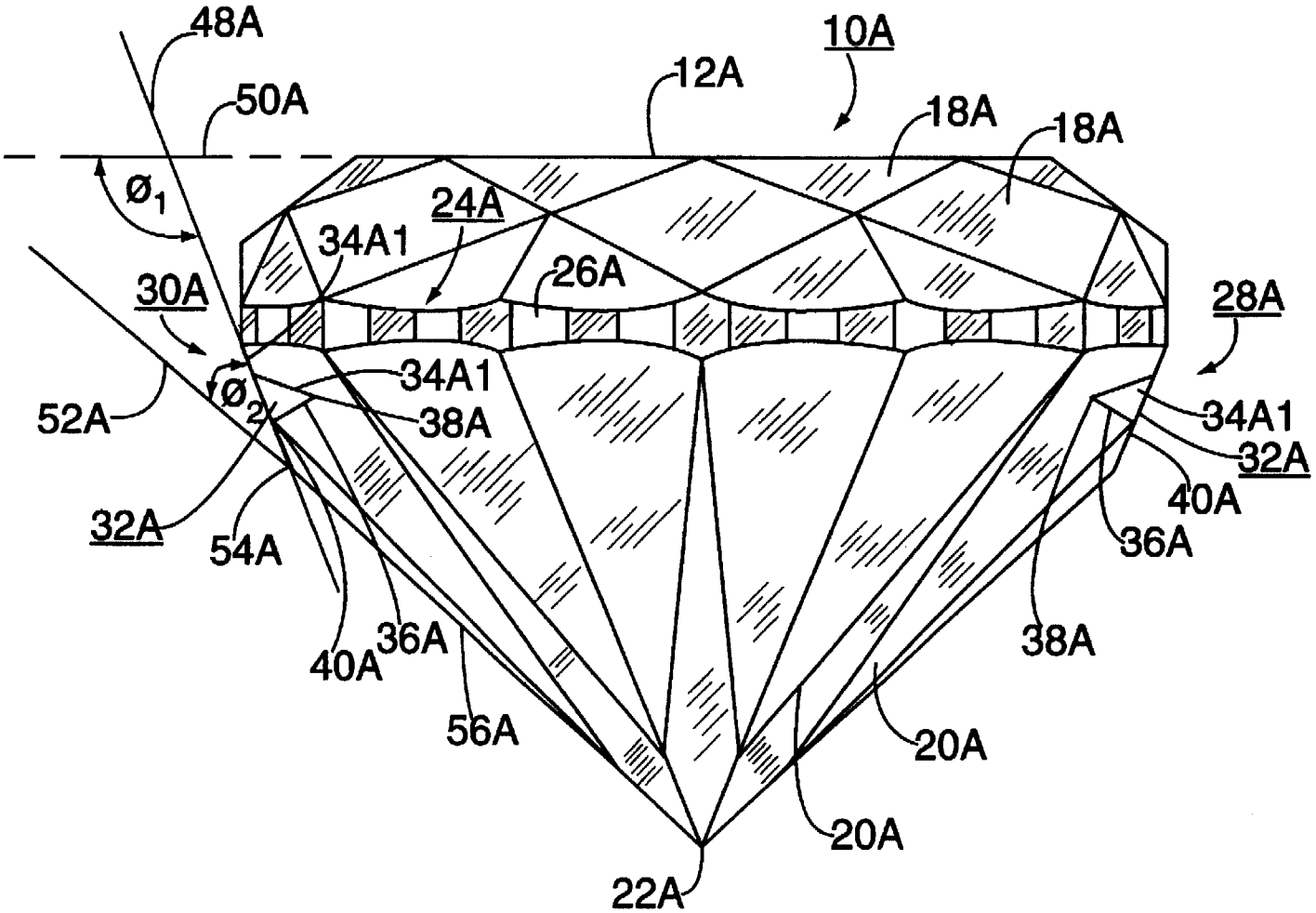
FIG. 4 is composed of FIGS. 4A, 4B, 4C and 4D each illustrating an end view respectively of the diamonds of FIGS. 2A–3A, 2B–3B, 2C–3C, and 2D–3D.

FIG. 4A is an end view of the generally round diamond 10A and illustrates dimensional lines 48A, 50A and 52A that define angles $\phi_1$ and $\phi_2$ that are applicable to both of the flattened portions 28A and 30A. As seen with reference to flattened portion 30A, also applicable to flattened portion 28A, a point 54A defines the uppermost location of the outermost facet 20A as indicated by the dimensional line 56A. The dimensional line 48A is drawn so as to be tangentially to point 54A and also in coincidence with boundary 40A previously described with reference to FIG. 1 as boundary 40. The dimensional line 50A coincides with the surface of the table 12A. The intersection of the dimensional lines 48A and 50A as shown in FIG. 4A defines the angle $\phi_1$.

As further seen with reference to flattened portion 30A, a dimensional line 52A coincides with and extends from the dimensional line 56A. The intersection of dimensional lines 48A and 52A as shown in FIG. 4A defines the angle $\phi_2$. From FIG. 4A it should be seen that angles $\phi_1$ and $\phi_2$ are both relative to the table 12A, and that $\phi_1$ and $\phi_2$ are unequal. More particularly, the angle $\phi_1$, is preferably obtuse, whereas the angle $\phi_2$ is preferably acute.

Further, from FIG. 4A, it should be seen that cut-out 32A comprises two sloped walls 34A and 36A, wherein (as previously mentioned) sloped wall 34A is directed inwardly and downwardly, whereas sloped wall 36A is directed inwardly and upwardly. The walls 34A and 36A merge and define a groove 38A which preferably extends the complete width of the cut-out 32A. The sloped wall 34A of cut-out 32A has an entrance portion 34A1 which is upwardly sloped (as viewed in FIG. 4A) so as to be in coincidence with dimension line 48A and share the defined angle $\phi_2$.

Figure 4B:
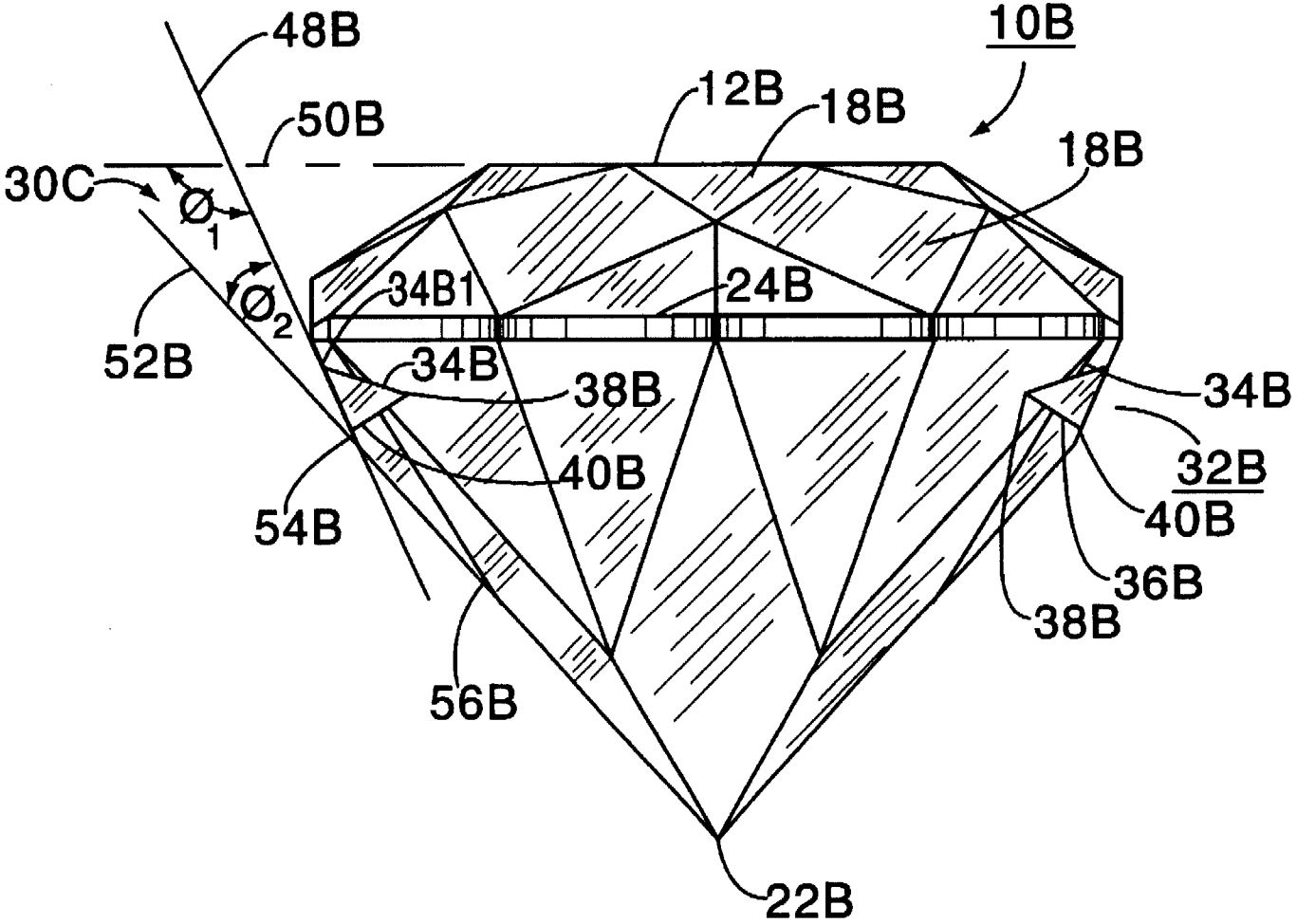
Figure 4C:
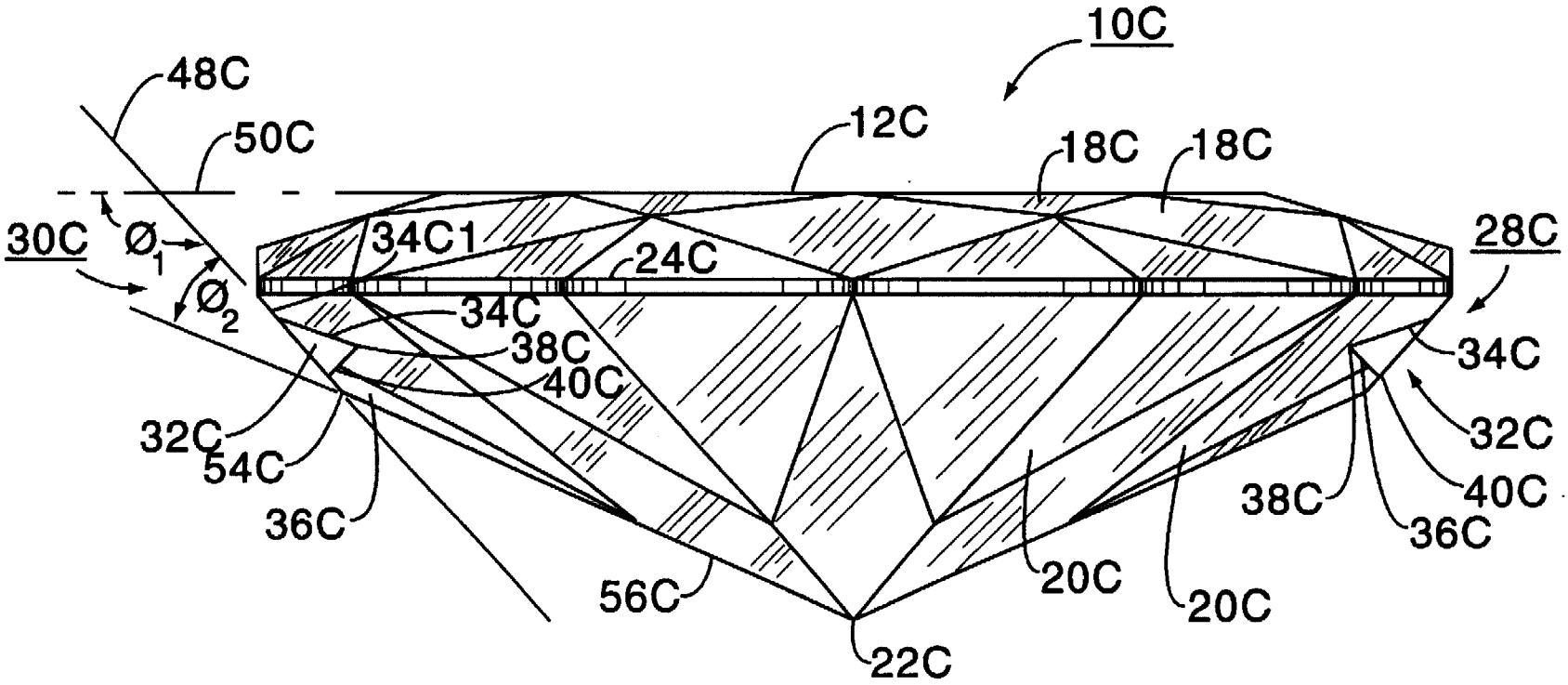
Figure 4D:
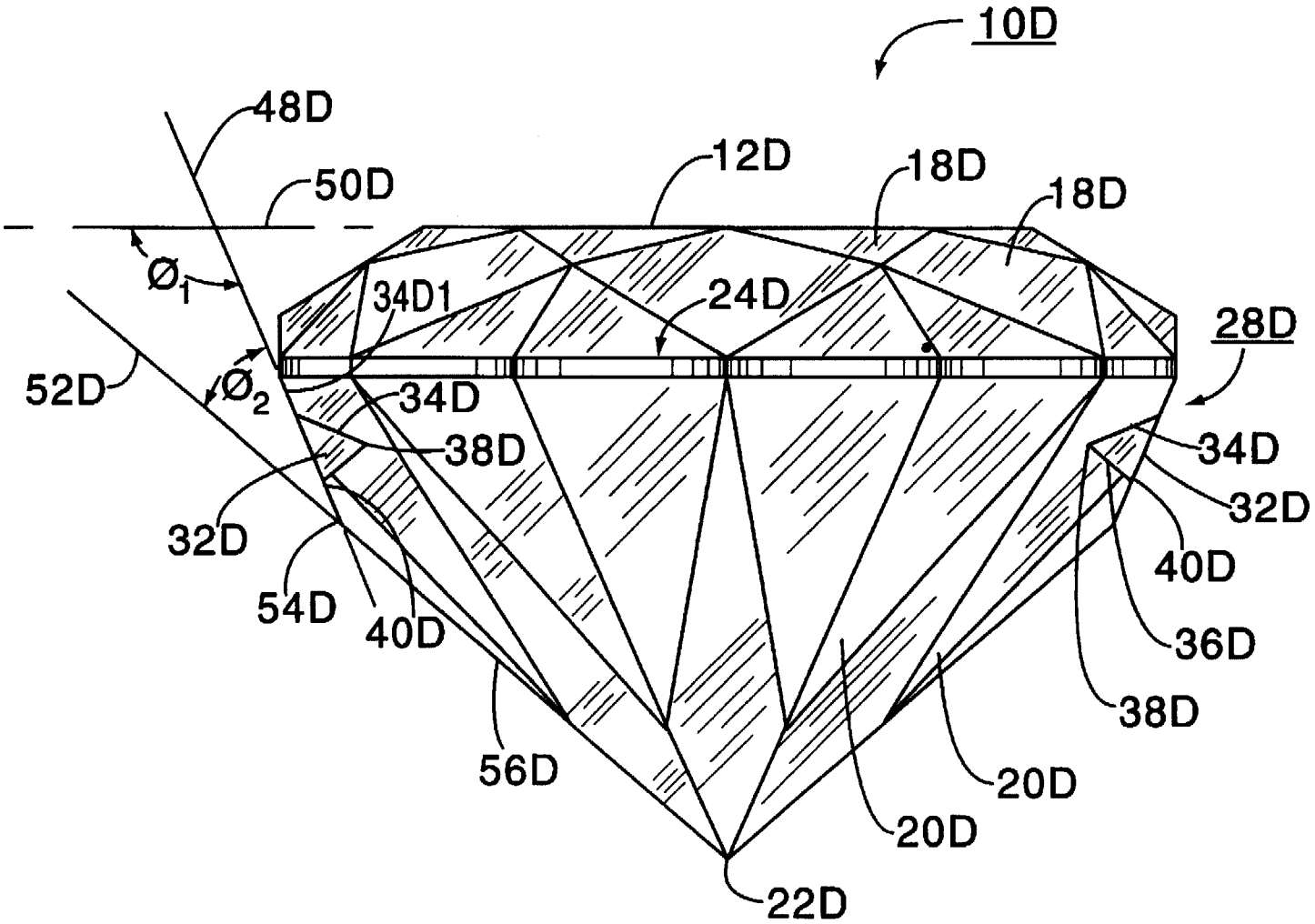

A review of FIGS. 4B, 4C, and 4D will respectively reveal the same features for the pear, marquise and oval diamonds as discussed for the generally round diamond 10A of FIG. 4A. It should be noted that the angles $\phi_1$ and $\phi_2$ are shown in FIGS. 4A, 4B, 4C and 4D free of the nomenclatures A, B, C and D of FIGS. 4A, 4B, 4C and 4D respectively. Further, although preferred, the facets 26A of generally round diamond 10A are not shown for the pear, marquise and oval diamonds. The dimensions of the cut-out 32A of generally round diamond 10A are of particular importance to the present invention and are to be further described with reference to FIG. 6. The generally round diamond 10A forms part of an article of jewelry 58A of the present invention, which may be further described with reference to FIG. 5.

Figure 5:
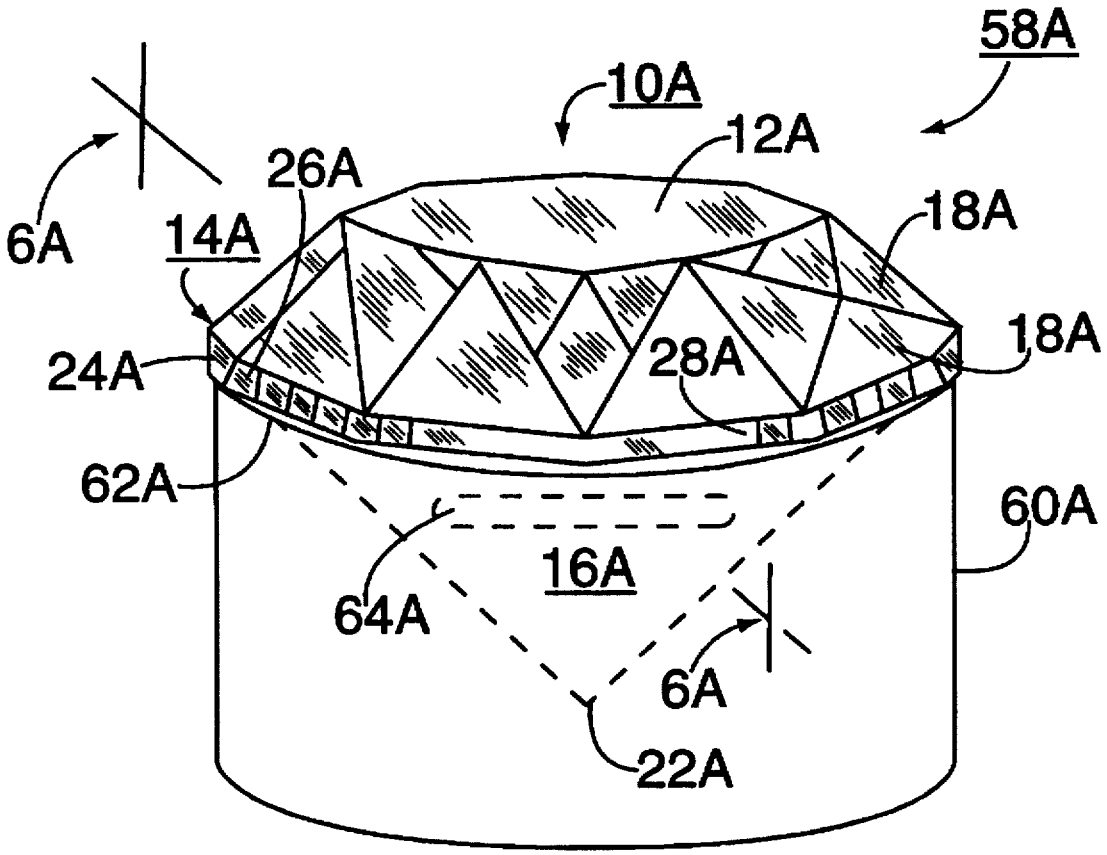
FIG. 5 is a perspective view illustrating the diamond of FIG. 1 being held in the barrel so as to form the article of the jewelry of the present invention.

FIG. 5 is a perspective view of the article of jewelry 58 which comprises the round diamond 10A and a barrel 60A having a rim 62A. Although barrel 60A is relatively plain shaped, the practice of this invention contemplates that the barrel 60A may have decorative shapes, each having a somewhat different esthetic appeal. As seen in FIG. 5, the barrel 60A, in particular the rim 62A, is located under the girdle 14A of the generally round diamond 10A and in actuality the rim 62A is hidden by the girdle 14A. The girdle 14A hides or makes invisible, to an observer, the rim 62A as well as reduces the prominence of the barrel 60A. More particularly, the barrel 60A has an inner diameter which is shaped and selected to have corresponding values that are less than both the first predetermined distance 44A and the outer diameter 46A of the generally round diamond 10A, both illustrated in FIG. 2A. Because the parameters of the round diamond 10A are larger than the shaped inner diameter of the barrel 60A, the barrel 60A remains partially hidden from view by an observer. Furthermore, because the girdle 14A covers the rim 62A, the rim 62A remains hidden from the view of an observer. Furthermore, the girdle 14A preferably includes the faceted belt 24A having the plurality of facets 26A which provide an esthetic appeal for the article of jewelry 58A and, thus, further distracts an observer from noticing either the barrel 60A or its rim 62A. The barrel 60A further comprises a ridge means 64A, located on the inner wall of the barrel 60A at oppositely disposed sides thereof so as to be in correspondence with the flattened portions 28A and 30A. The parameters of the generally round diamond 10A and the location and dimensions of the ridge means 64A are selected in a complementary manner so that the generally round diamond 10A becomes set in the barrel 60A and is hidden from a viewer of the generally round diamond 10A. In addition, the practice of the present invention allows the generally round diamond 10A to be easily and rigidly set or attached to the barrel 60A, which may be further described with reference to FIG. 6, which is a view taken along line 6—6 of FIG. 5.

Figure 6:
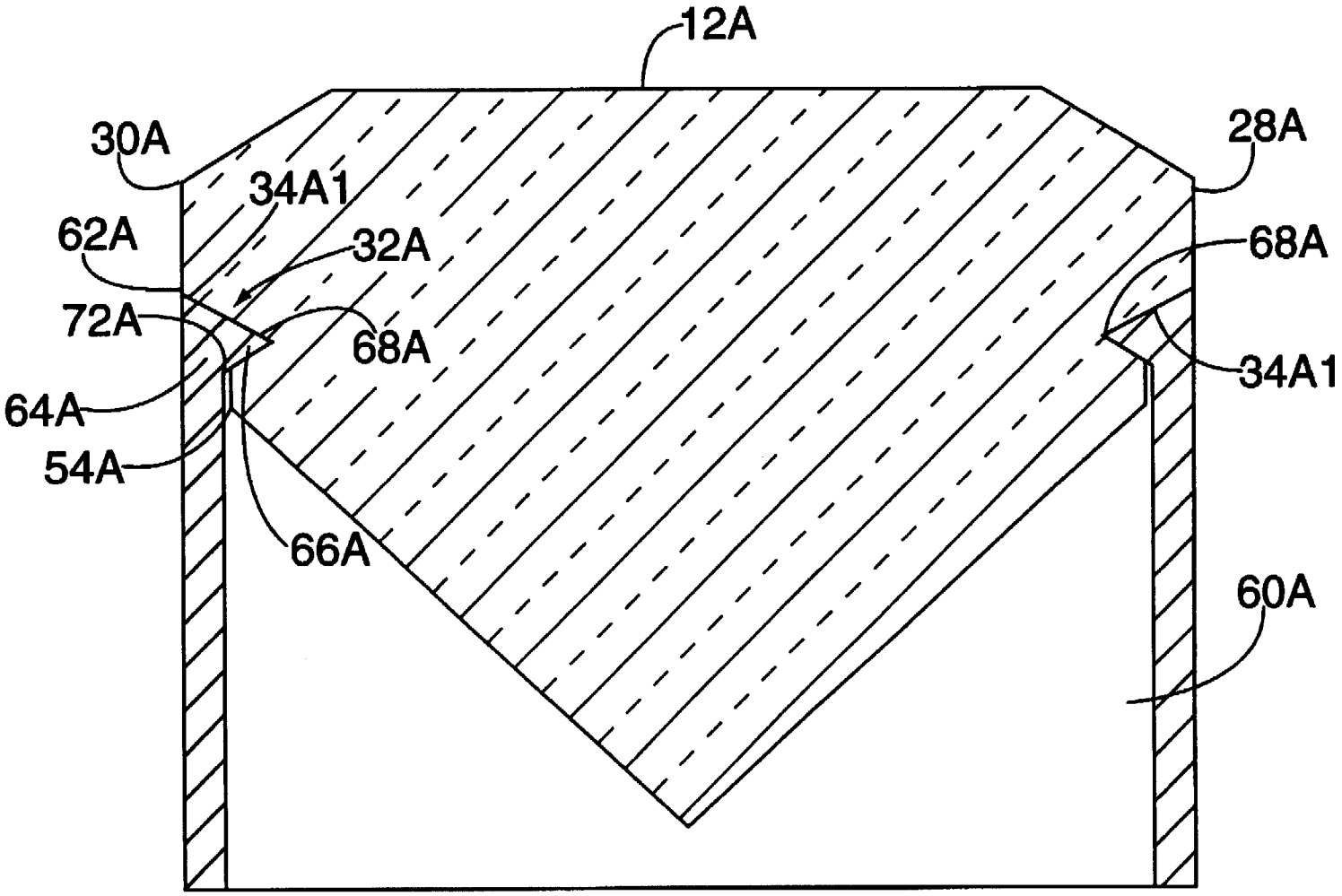
FIG. 6 is a sectional view taken along lines 6—6 of FIG. 5.

FIG. 6 is a cross-sectional view that illustrates, with respect to flattened portion 30A (also applicable to flattened portion 28A), that the ridge means 64A has a prong 66A with a tip 68A and a lip which serves as the rim 62A shown in FIG. 5. The upward sloped portions 34A1 of flattened portions 28A and 30A each rests on the rim 62A. The prong 66A is selected to have complementary dimensions as those of the cut-out 32A in both of the flattened portions 28A and 30A. Further, the tip 68A is selected to have dimensions so as to frictionally engage at least a portion of the sloped wall 34A.

More particularly, as seen in FIG. 6 with reference to the flattened region 28A, the sloped wall 34A is shown in phantom, whereas the tip 68A is shown as engaging the sloped wall 34A. As further seen in FIG. 6, the ridge means 64A not only frictionally engages the cut-out 32A by means of its tip 68A, but also because of its other dimensions completely occupies the cut-out 32A and, thereby, allows the generally round diamond 10A to be rigidly attached to the barrel 60A, so as to eliminate any propensity of the generally round diamond 10A from being accidentally dislodged from its barrel 60A.

The material of the barrel 60A is selected to provide an elasticity characteristic so that the ridge means 64A not only tucks itself into the cut-out 32A, but also deforms slightly so as to assist in maintaining frictional engagement between the tip 68A of the ridge means 64A and the sloped wall 34A of each of -the flattened portions 28A and 30A. A material that provides for such elasticity, while contributing to the luster of the article of jewelry 58A, is gold. Further, the elasticity characteristic of the barrel 60A allows for the generally round diamond 10A to be pressed downward and onto the ridge means 64A so that the ridge means 64A finds its way into the cut-out 32A of each of the flattened portions 28A and 30A in a snap-lock manner. Furthermore, the location of ridge means 64A on the barrel 60A is selected so that the prisms 26A of the girdle 14A provide an effect that tends to visually hide the barrel 60A from being perceived by a viewer of the generally round diamond 10A.

Figure 2B:
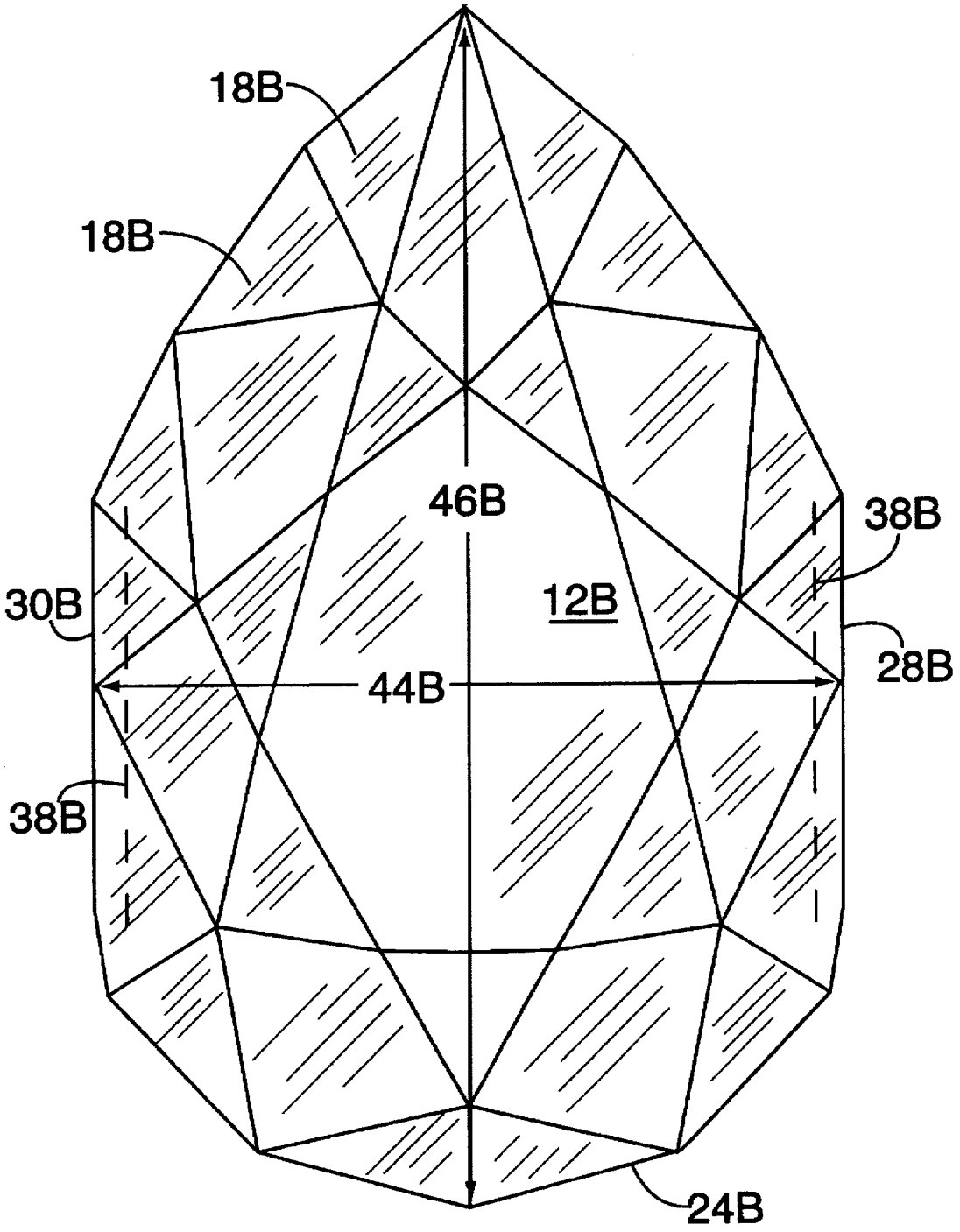
Figure 2C:
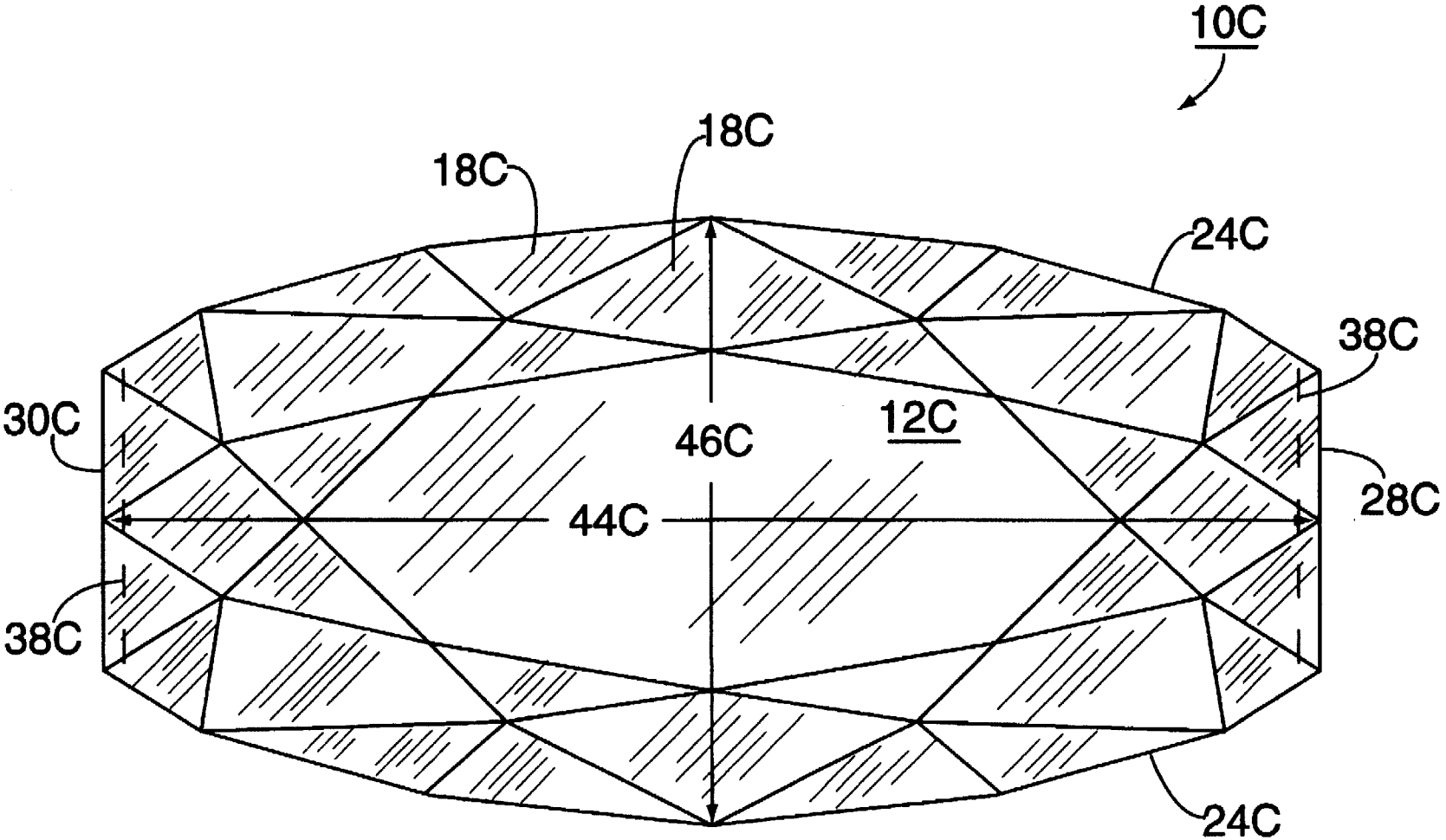
Figure 2D:
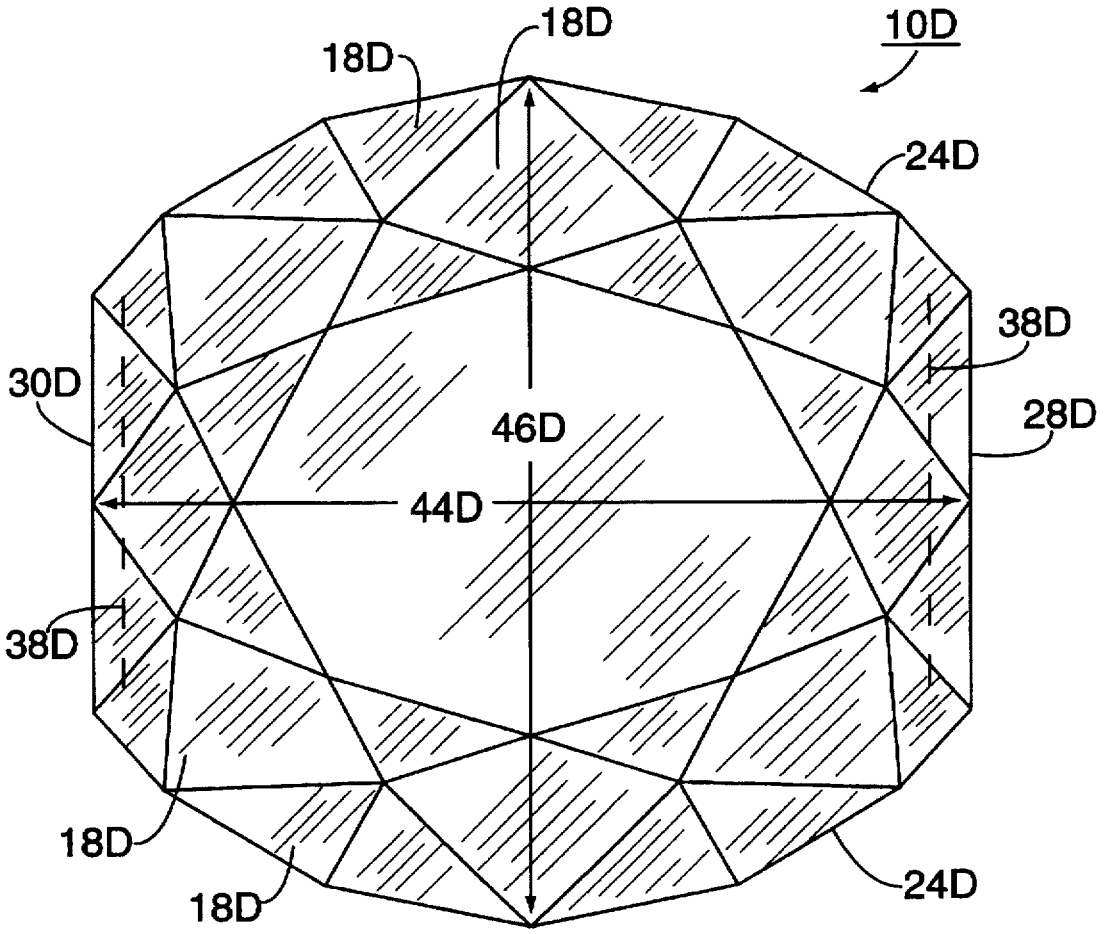
Figure 3B:
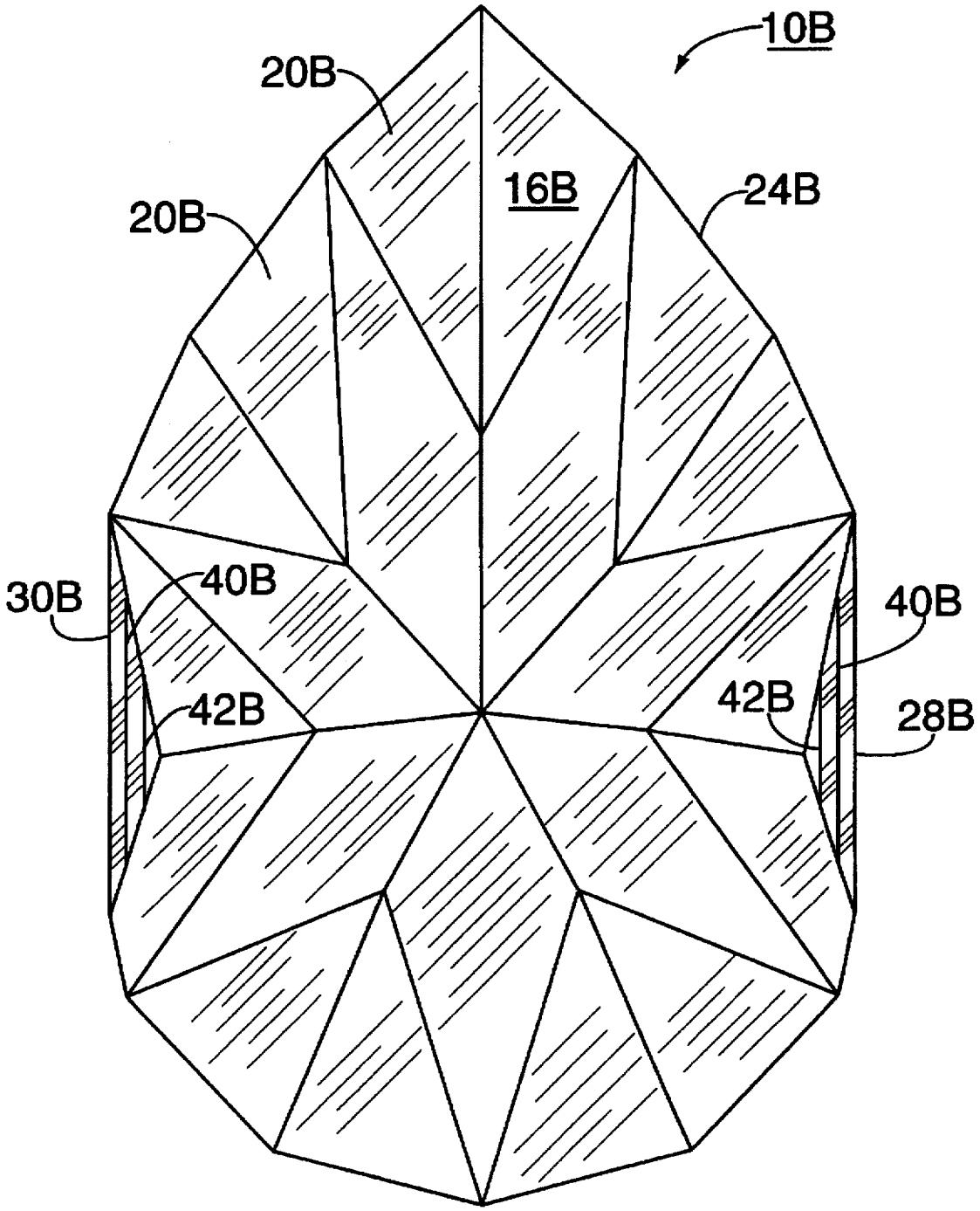
Figure 3C:
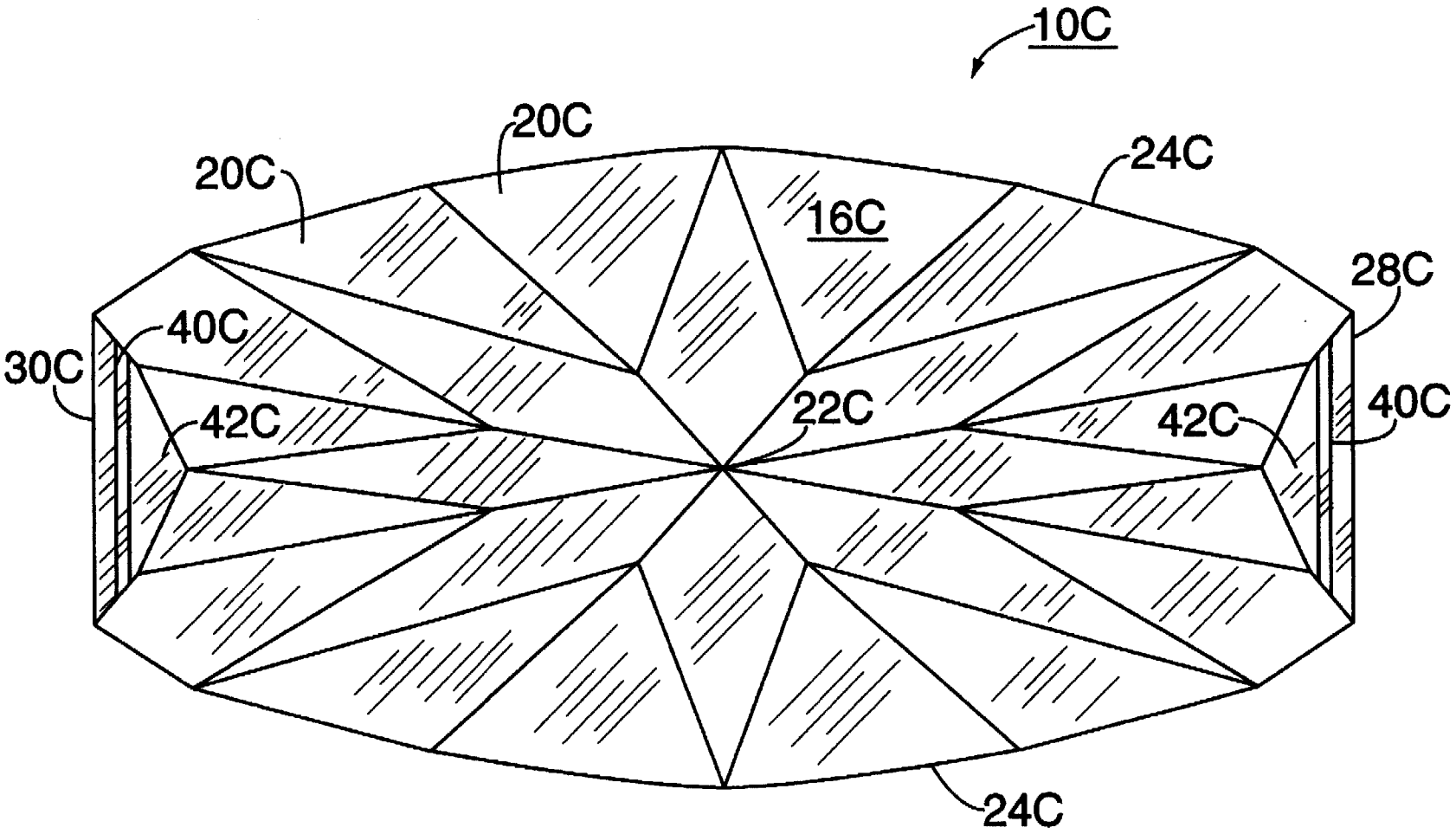
Figure 3D:
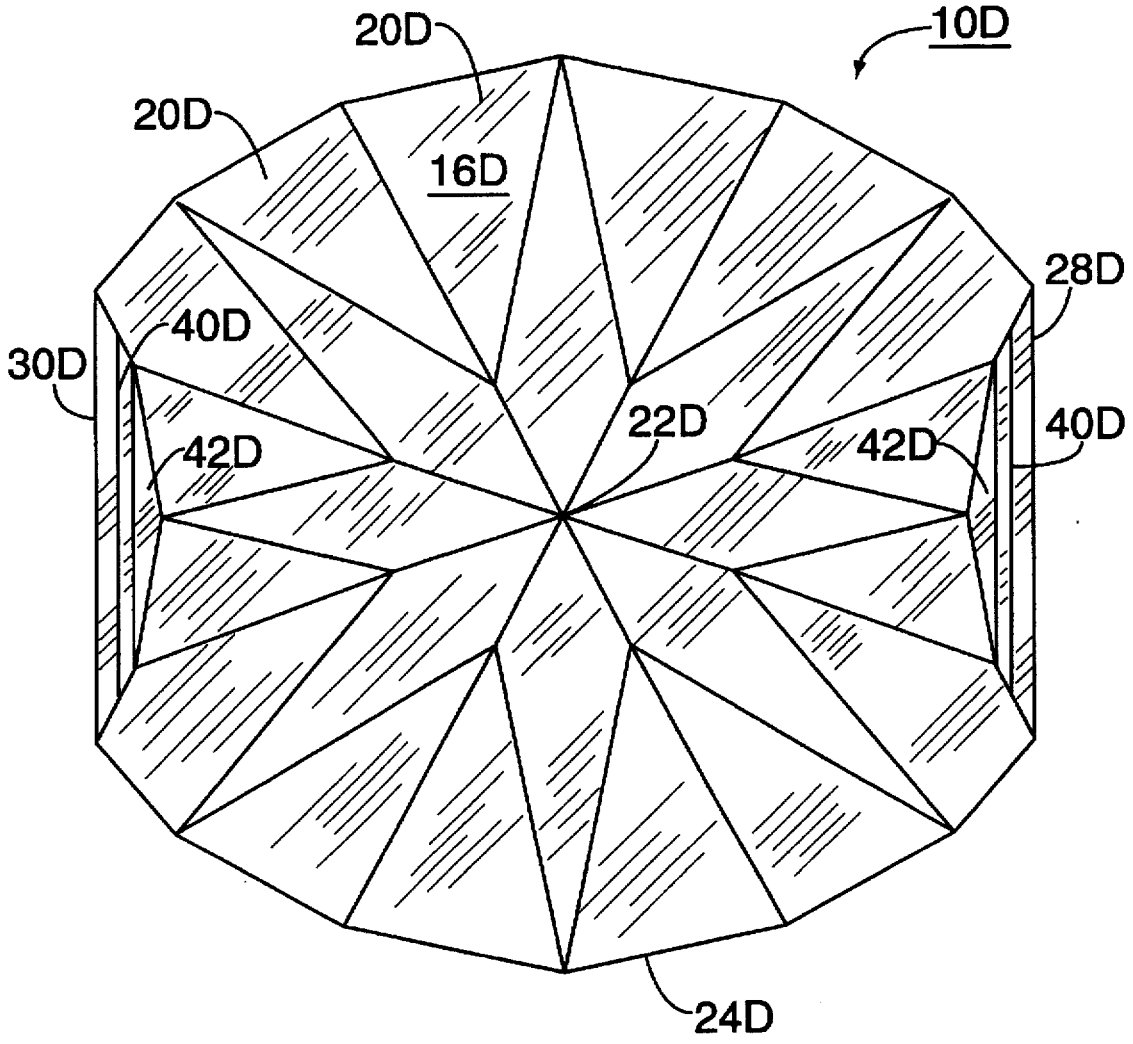

Although the hereinbefore given description of FIGS. 5 and 6 was related to the generally round diamond 10A of FIGS. 1, 2A, 3A and 4A; the pear, marquise and oval diamonds of FIGS. 2B, 3B and 4B; 2C, 3C and 4C; and 2D, 3D and 4D, respectively, are equally mountable in a barrel, such as barrel 60A, having its dimensions selected, in a manner as described with reference to FIGS. 5 and 6, so as to be complementary with the pear, marquise or oval diamond.

It should now be appreciated that the practice of the present invention provides for the generally round diamond 10A, the pear diamond 10B, the marquise diamond 10C and the oval diamond 10D to be easily and rigidly set in the holders 60A, 60B, 60C and 60D respectively. Furthermore, the diamonds 10A, 10B, 10C and 10D preferably have faceted belts 24A, 24B, 24C and 24D, which makes or substantially contribute to having the holders 60A, 60B, 60C and 60D, respectively, less visible to the normal eye than the respective diamond. In a manner as previously described with regard to the description of the diamonds 10B, 10C and 10D, the holders 60B, 60C and 60D, respectively, are not shown in FIG. 6 but the description of holder 60A is equally applicable to holders 60B, 60C and 60D. As worn, the diamonds 10A, 10B, 10C and 10D set in accordance with the practice of the present invention, prevents the luster of the diamonds 10A, 10B, 10C and 10D from being retarded by the respective setting.

This invention has been described with reference to a preferred embodiment, and the scope and protection of this invention is as set forth in the appended claims.

What I claim is:

1. An article of jewelry comprising:

(a) a diamond having a table with a top surface, a girdle and a pavilion located below the girdle, said girdle having first and second oppositely disposed flattened portions spaced apart by a first predetermined distance, each flattened portion having a cut-out having a predetermined width and at least two sloped walls that run substantially parallel to said top surface of said table, said sloped walls being orientated so that one is directed in a first direction which is inward and downward into the diamond and the other of which is directed in a second direction opposite to said first direction so that said at least two sloped walls converge and merge to form a groove that extends across the width of said cut-out and runs substantially parallel to said top surface of said table, and (b) a mount having a bore with a diameter which is less than said first predetermined distance of said girdle and having an inner wall with a ridge mean with sides oppositely disposed from each other to correspond to said flattened portions and having a prong, said prong being dimensioned to snugly fit into said cut-outs of said flattened portions and to have a tip that engages one of said sloped walls of said cut-outs.

2. The article of jewelry according to claim 1, wherein one of said sloped walls of each of said cut-outs further comprises an entrance portion with an upwardly directed portion having a first defined angle relative to said top surface of said table and wherein said barrel has a rim dimensioned so that said entrance portions rest thereon.

3. The article of jewelry according to claim 1, wherein said girdle has facets around its perimeter, except at said flattened portions thereof.

4. The article of jewelry according to claim 1, wherein said barrel comprises a material having an elasticity characteristic so as to assist said ridge means to maintain its engagement with said sloped walls of said cut-outs.

5. The article of jewelry according to claim 4, wherein said material is gold.

6. The article of jewelry according to claim 1, wherein said diamond is selected from the group comprising a generally round diamond, a pear diamond, a marquise diamond and an oval diamond.

* * * * *